US005959579A

United States Patent [19]

Gladh

[11] Patent Number: 5,959,579

[45] Date of Patent: Sep. 28, 1999

[54] TRANSMITTER INTERFERENCE REJECTION

[75] Inventor: Olle Gladh, Hässelby, Sweden

[73] Assignee: Telefonaktiebolaget LM Ericsson, Stockholm, Sweden

[21] Appl. No.: 08/998,765

[22] Filed: Dec. 29, 1997

[30] Foreign Application Priority Data

Dec. 30, 1996 [SE] Sweden ..... 9604830

[51] Int. Cl.[6] ..... H01Q 3/22

[52] U.S. Cl. ..... 342/375; 455/562

[58] Field of Search ..... 342/375, 368; 455/101, 103, 561, 562

[56] References Cited

U.S. PATENT DOCUMENTS

| | | | |
|---|---|---|---|
| 4,314,250 | 2/1982 | Hanell et al. | 342/372 |
| 4,918,684 | 4/1990 | Boschet et al. | 370/17 |
| 5,548,813 | 8/1996 | Charas et al. | 343/890 |
| 5,742,258 | 4/1998 | Kumpfbeck et al. | 343/795 |

FOREIGN PATENT DOCUMENTS

0117240A1 8/1984 European Pat. Off. .

*Primary Examiner*—Gregory C. Issing
*Attorney, Agent, or Firm*—Burns, Doane, Swecker & Mathis, L.L.P.

[57] ABSTRACT

The present invention relates generally to the use of antenna array systems used in e.g., mobile radio systems. Interfering signals are received from adjacent antenna arrays. These result in intermodulation ("IM") products which interfere with the transmission of the desired signals. Because these IM products are transmitted along the path between the amplifier and the antenna element, it is possible to adjust the length of this path from element to element, thereby shifting the wavefront of the IM products so that they are less coherent. To keep the total transmission length for the desired signal constant, the length between the splitter and amplifier is adjusted so that the total transmission length stays constant from splitter to antenna element. The result is that the wavefront for the desired signal stays coherent while that for the IM products does not. This provides less interference from the IM products.

6 Claims, 6 Drawing Sheets

TRANSMITTER INTERFERENCE REJECTION

FIELD OF THE INVENTION

The present invention relates generally to the use of antenna array systems used in e.g., mobile radio systems, and more particularly to the techniques for reducing interference between such arrays.

RELATED ART

The demand for capacity in base station sites used in mobile radio communications systems is increasing rapidly. A consequence of this is an increase in the demands on the antenna systems used in such radio systems. An arrangement of typical components in the transmitter path for a mobile radio system is shown in FIGS. 1 and 2. Shown are a splitter 50, amplifier 40, isolator 30, filter 20 and antenna element 10.

The most common method of implementing antenna systems is to use one amplifier which is not placed up in the antenna column. Another method is to use one amplifier placed in the transmitting tower. An example of this is shown in FIG. 1. Illustrated here are three columns 1–3 of transmitters as might typically be found on a transmitting tower at a base station in a mobile radio communications system. Associated with several antenna elements, 10*a*–10*d*, will be one splitter 50, one amplifier 40, one isolator 30, and one filter 20. The signal to be transmitted is sent to the amplifier 40 from the base station, not shown here, before being sent to the one splitter 50, which will divide the radio signal to be transmitted to a number of antenna elements 10*a*–10*d*.

Another method being used in some systems is to provide a separate amplifier placed up in the transmitting tower for each antenna element. A system such as this is shown in FIG. 2, with three columns 1–3 of transmitters as might typically be found on a transmitting tower at a base station in a mobile radio communications system. It can be seen that the signal is first sent to a single splitter 50 from a base station, not shown here, where the signal is split before being sent to the respective antenna elements 10*a*–10*d* to be broadcast. Each antenna element 10*a*–10*d* will then have its own amplifier, 40*a*–40*d* respectively, isolator, 30*a*–30*d* respectively, and filter, 20*a*–20*d* respectively.

The antenna columns containing elements 10*a*–10*d* shown in FIGS. 1 and 2 are usually mounted in arrays on transmitting towers. They can be mounted in linear or circular arrays. An example of a common circular array on a tower is shown in the top view of FIG. 3*a*. Shown here are four columns 1–4 spaced every 90 degrees around a transmission tower 5. Each column contains an array of antenna elements 10*a*–10*d* as illustrated in FIG. 1. Only the top antenna element 10*a*, corresponding to the top antenna element 10*a* in FIGS. 1 and 2, is shown. It can be appreciated that the number and spacing shown here are for illustration only. A typical system will probably have 8 or 16 antenna elements for each column.

Shown in FIG. 3*b* is a corresponding front view of the same tower as in FIG. 3*a*. A front column 4 and two side columns 1, 3, each having four antenna elements 10*a*–10*d* are shown. The back column 2 is not visible behind the transmission tower 5. This arrangement of antenna elements is sometimes used for Space (or "Spatially") Divided Multiple Access("SDMA"), a method of combining transmitters geometrically in space to provide efficient access to the radio transmitters and receivers.

Due to problems with space limitations, especially in urban environments, the antenna elements 10*a*–10*d* are arranged quite close together. They are also arranged quite close to each of their amplifiers, e.g. 40 FIG. 1, isolators, e.g. 30 FIG. 1, and filters, e.g. 20 FIG. 1. This tight arrangement in arrays greatly increases the risk of interference. It also increases the equipment requirements on the filter and isolator due to other carrier interference risk from adjacent antenna columns.

In those antenna systems having a separate amplifier for each antenna element, see FIG. 2, the amplifiers 40*a*–40*d* are usually operated in a non-linear mode, although they may be operated in linear mode. It is well known in the art that a non-linear amplifier receiving signals of two different frequencies will provide outputs at each of those two frequencies as well as intermodulation ("IM") product outputs at the sum and difference frequencies of those two signals. In these tight arrangements of antenna arrays, a given antenna element 10*a*–10*d* will receive quite strong interference signals from adjacent arrays.

This interference signal will be forced back through the filter 20*a*–20*d* and isolator 30*a*–30*d* to the power amplifier 40*a*–40*d* where it will mix with the desired signal to form the IM products. These IM products often interfere with the desired frequencies. This problem of reducing the risks of intermodulation interference has been faced using several different methods in the past.

One method has been to operate the amplifiers in a linear mode so that IM products are not generated, or are at least held to a minimum. This is a poor solution, however, because linear amplifiers have a low DC-to-RF efficiency which will significantly hinder the operation of the array.

Another approach is shown in U.S. Pat. No. 4,498,083 which involved cancelling multiple sources of interference in an antenna array. It provided a technique of checking the phase angle of an incoming interference signal and then using phase shifters to vary the received signal in relation to the interfering signal. Each interfering signal required a doubling of elements need to deal with the signal; for example 4 interfering signals would require 16 elements in a linear array.

Although the basic problem dealt with in U.S. Pat. No. 4,498,083 was similar, the specific problem was different. It dealt more specifically with independently tracking and varying the phase of a multiple of interfering signals. The problem and solution were different than that in the present application.

Another example of a prior approach is in U.S. Pat. No. 4,500,883. Again, here the problem was that of independently tracking and cancelling interfering signals from multiple sources. The basic idea was to provide a means so that the interfering signal arriving at any pair of antenna elements would arrive 180 degrees out of phase. A servo motor was provided to adjust the position of the antenna elements in response to measured levels of interference. This technique is also quite different from that of the present invention.

Yet another example of prior approaches is found in U.S. Pat. No. 4,314,250 which was more specifically focused on the intermodulation products that result from active type of antennae where each antenna element is provided with its own amplifier, as in the present invention. The invention in this patent adjusted the phase tilt of the carriers across the array of antenna elements.

Although the technique of U.S. Pat. No. 4,314,250 does decrease the intermodulation products in active type antennae, it does so by changing the phase tilt of the carrier frequencies.

SUMMARY OF THE INVENTION

As has been seen, to achieve high power output in many modern mobile radio stations, each antenna column uses one amplifier placed up in the transmitting tower per antenna element. Each component will have its own isolator and filter also, resulting in a large number of components. One factor affecting the size and cost of these components are intermodulation ("IM") products. Any technique which can increase the IM product rejection will result in decreased requirements on these other components.

Accordingly, it is an object of the present invention to reduce interference between antenna arrays in a mobile radio station, each array including a number of antenna elements, creating certain and different transmission lengths for each antenna element so that the sum of IM products will not appear coherent from the antenna column. This can be accomplished by dividing the transmission length from the power output of the amplifiers to the antenna elements into N phases, where N is the number of antenna elements on the antenna column. The amplifiers may be single carrier or multicarrier amplifiers.

This object creates an incoherent sum of IM products from the antenna column. However, by itself, it creates an incoherent sum from the desired transmitted signals also. Accordingly, it is another object of the present invention to compensate the length in the transmission length from the amplifiers to the antenna elements with a corresponding offset in transmission length at the input transmission line of each power amplifier.

Briefly described, the present invention accomplishes the above and other objectives in the following manner. An antenna column is used, with N antenna elements, each with its own power amplifier, isolator and filter. The first element N=1 is at the top of the column. Each succeeding element is directly below the previous element, so that N=2 is directly below N=1, and so on until we reach the bottom element N=N.

A length dL is calculated based on the electronic wavelength L. The transmission length between the first amplifier and the first antenna element is L. The transmission length between the second amplifier and the second antenna element is L+dL. Each succeeding transmission length is increased by a length dL, so that the third transmission length is L+2dL, the fourth is L+3dL, and so on. The transmission length between the Nth amplifier and the Nth antenna element will then be L+(N−1)dl.

This will result in a "steering" of the column of IM products, effectively creating an IM beam that is tilted downwards or upwards. The result is that the IM products will not appear coherent to other adjacent antenna columns at the base station. However, the desired signals to be transmitted will also be "steered" unless some means is provided to prevent this. This can be done by first noticing that the total transmission length for the desired signal can be divided into to parts, from the splitter to the power amplifier, then from the power amplifier to the antenna element.

In the present invention the transmission length from the power amplifier to the antenna element increases by an amount dL as we proceed from the first amplifier-element pair through the last. In order to keep the total transmission length constant as we proceed from first amplifier-element pair through the last, we then need to subtract this length dL from the transmission length between the splitter and the power amplifier. Accordingly, the transmission length between the splitter and the power amplifier for the first amplifier will be L.

The transmission length between the splitter and the amplifier for the second amplifier will be L−dL. This will continue in a manner such that the transmission length between the splitter and the amplifier will decrease by an amount dL for each successive amplifier. The length between the splitter and the amplifier for the Nth amplifier will then be L−(N−1)dL. The result of this is that the total transmission length for the desired radio signal remains a constant 2L for each splitter-amplifier-antenna element path. The path for the IM products is shifted as described above so that it is not coherent in relation to the desired signal or in relation to adjacent antenna columns.

BRIEF DESCRIPTION OF THE DRAWINGS

The present invention will now be described in more detail with reference to preferred embodiments of the present invention, given only by way of example, and illustrated in the accompanying drawings, in which.

DETAILED DESCRIPTION

Figure 1:
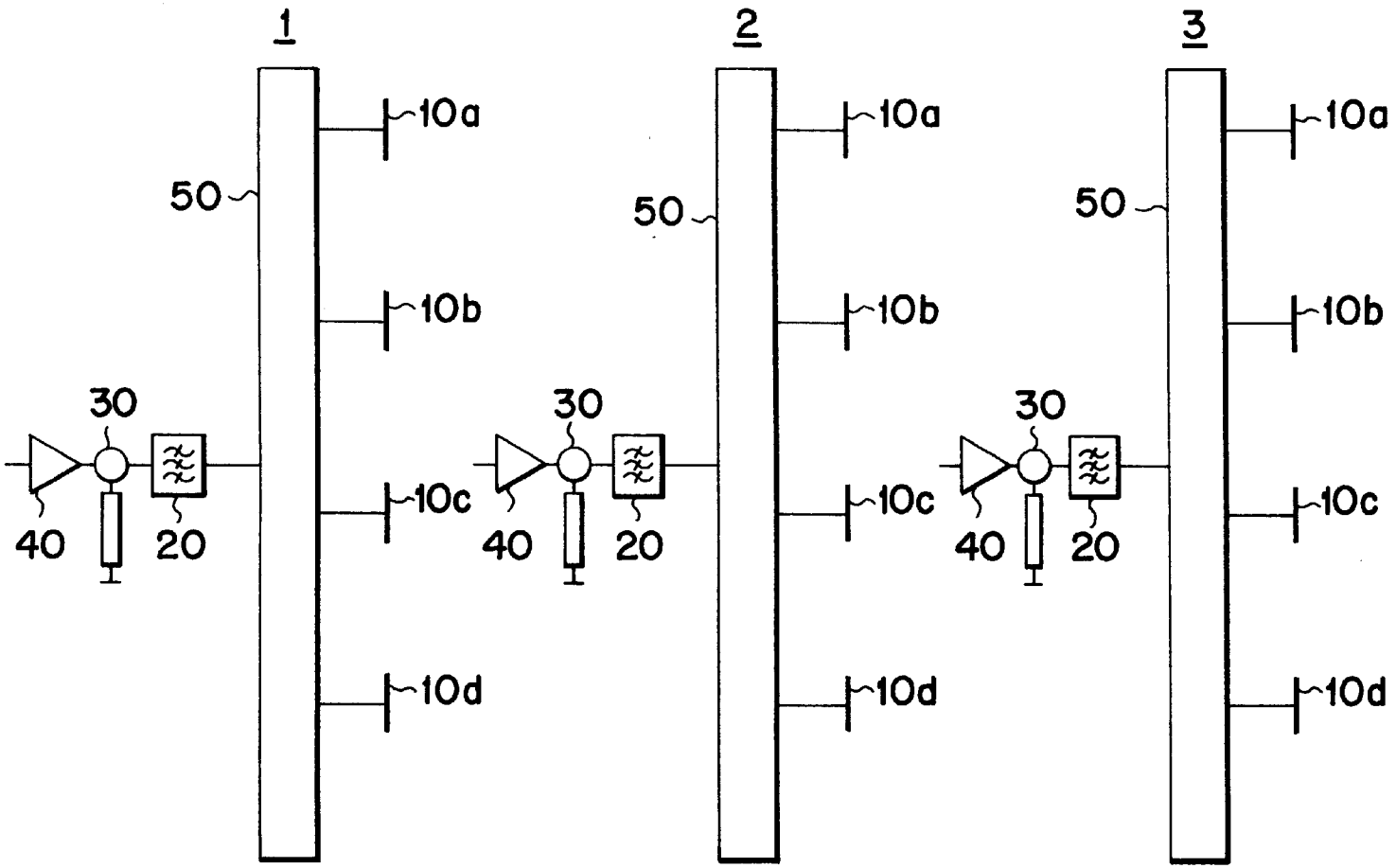
Fig. 1 (PRIOR ART)
FIG. 1 is a diagram of three antenna columns with four antenna elements each, wherein only one amplifier and filter and isolator are provided for all the antenna elements.
Figure 2:
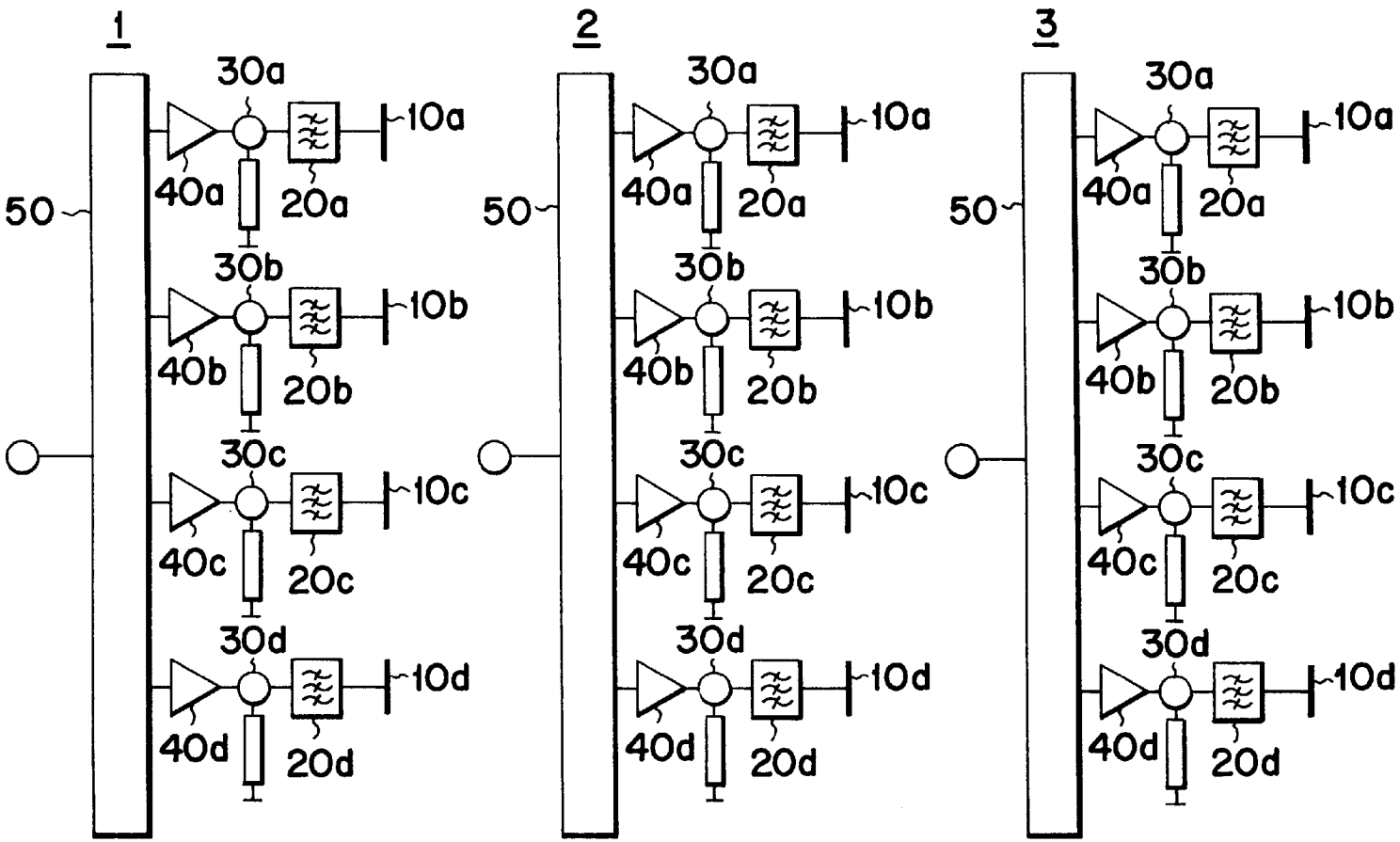
Fig. 2 (PRIOR ART)
FIG. 2 is a diagram of three antenna columns with four antenna elements each, wherein each antenna element is provided with its own amplifier and filter and isolator.
Figure 3A:
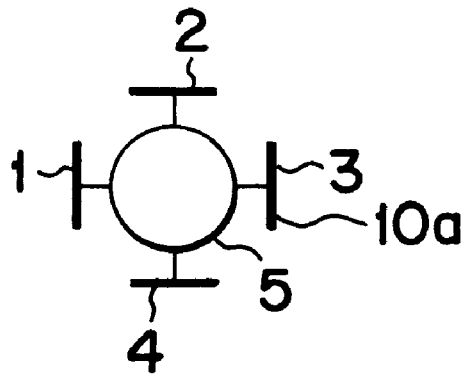
Fig. 3a (PRIOR ART)
FIG. 3*a* is a top view of a radio transmission tower having four columns of antenna elements in a circular array.
Figure 3B:
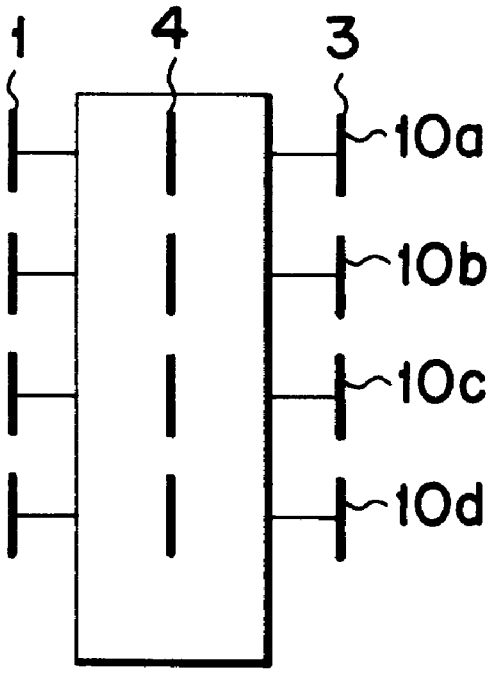
Fig. 3b (PRIOR ART)
FIG. 3*b* is a front view of the radio transmission tower in FIG. 3*a* having four columns of antenna elements in a circular array.
Figure 4:
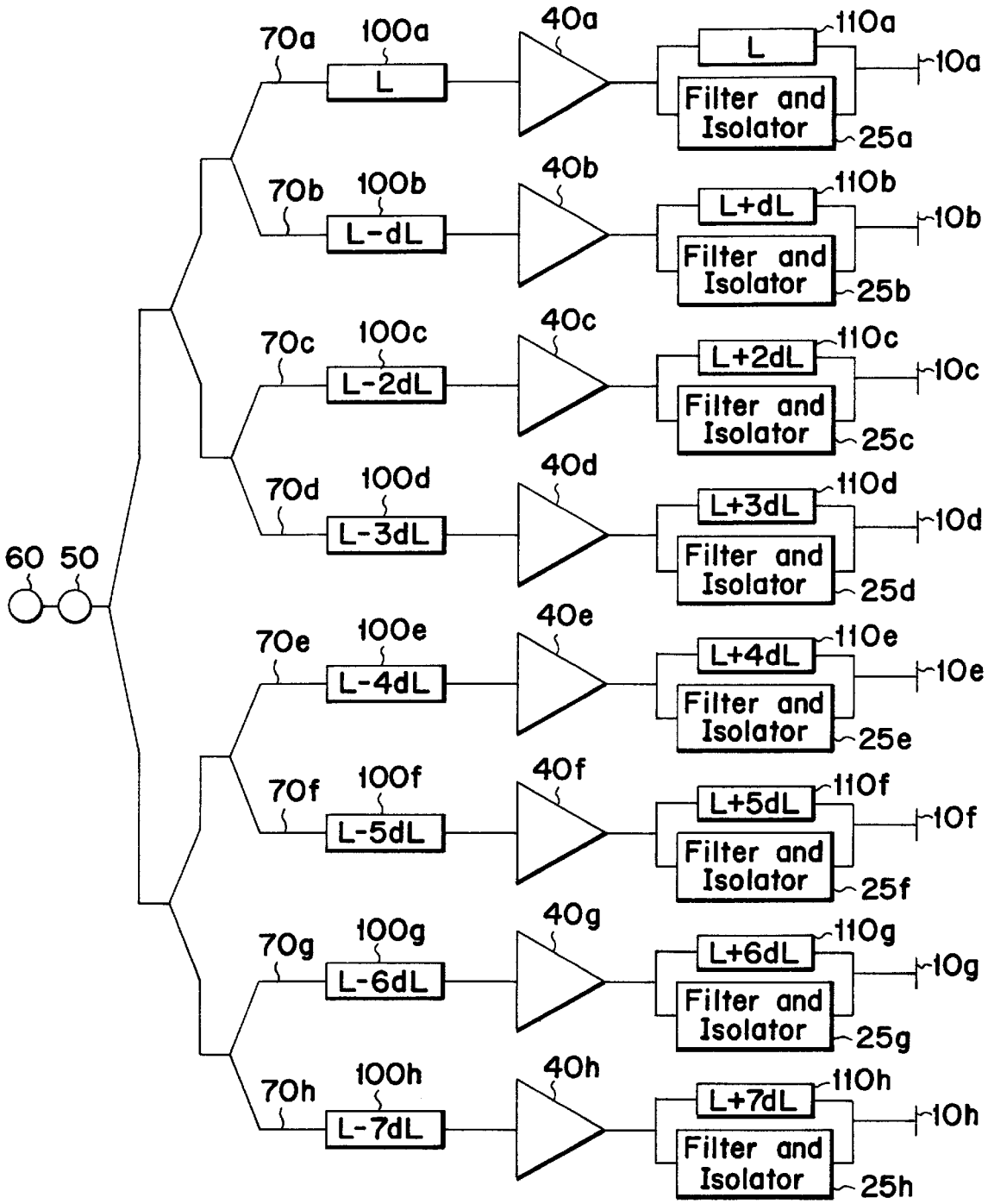
FIG. 4 illustrates cutaway view of the preferred embodiment of the present invention wherein the transmission lengths are varied to provide equal distant phase generation for the IM products.

In FIG. 4 is seen the preferred embodiment of the present invention, an equal distant phase intermodulation ("IM") product generation for the case of an 8 dipole antenna column. It can be appreciated that an 8 dipole column is chosen here for ease of explanation, and the present invention will work for any number of antenna elements in a column. The radio signal begins at a source 60 located in the base station, not shown here. The signal is split in a splitter, 50 FIGS. 1, 2, and then sent to the various antenna elements 10*a*–10*h* along a variety of paths 70*a*–70*h*. Each antenna element 10*a*–10*h* has its own amplifier 40*a*–40*h* and filter-isolator 25*a*–25*h* (shown located together for illustration purposes).

The distance L is the electrical wavelength. A distance dL is then calculated from dL=(L/2)/N, where N is the number of antenna elements 10*a*–10*h* in the column. In FIG. 4 N=8, so dL=(L/2)/8. The distance of a first part of the signal path, symbolised by block 100*a*, the signal travels to the first amplifier 10*a* is equal to L, which is also equal to the distance of a second part of the signal path, symbolised by block 110*a*, the signal must subsequently travel from the first amplifier 40*a* to the first antenna element 10*a*. It is seen that the total distance travelled for the signal from the splitter 50 to the first antenna element 10*a* is 2L.

This contrasts with the distances for antenna element number two 10*b*. Here the signal first travels a first part of the signal path corresponding to a distance 100*b*, equal to L−dL, to the second amplifier 40*b* before travelling a second part of the signal path corresponding to a distance 110*b*, equal to L+dL, between the second amplifier 40*b* and the second antenna element 10*c*. Here the signal travels again a total distance of 2L from the splitter 50 to the second antenna element 10*b*.

For each subsequent antenna element 10*a*–10*h* the first parts of the signal paths corresponding to the distances 100*a*–100*h* between the signal splitter 50 and amplifier 40*a*–40*h* are decreased, while the corresponding second parts of the signal paths corresponding to the distances 110*a*–110*h* between the amplifiers 40*a*–40*h* and antenna elements 10*a*–10*h* are increased. For any given amplifier 10*a*–10*h* numbered N, N=1–8, the distance travelled by the signal from splitter 50 to amplifier 40*a*–40*h* is L−(N−1)dL. Therefore, for example, the distance travelled by the signal from the splitter 50 to the seventh amplifier 40 g (N=7), is L−6dL.

For any given amplifier 40*a*–40*h* numbered N, N=1–8, the distance 110*a*–110*h* then travelled by the signal from the amplifier 40*a*–40*h* to its corresponding antenna element 10*a*–10*h* is equal to L+(N−1)dl. So, for example, the distance 110*h* travelled by the signal from the eighth amplifier 40*h* (N=8) to the eighth antenna element 10*h* is equal to L+7dL. However, it will quickly be seen that the total distance travelled by the signal in every case from the splitter 50 to antenna element 10*a*–10*h* is 2L. Therefore the distance travelled by the desired signal remains in phase in every case.

The situation is far different, however, when we consider the IM products. Interfering signals are received from nearby antenna columns at the various antenna elements 10*a*–10*h* along a given column. These interfering signals are then forced backwards from the antenna element, e.g. 10*a*, through the filter and isolator, 25*a* respectively, to the amplifier, 40*a* respectively. They then combine with the desired signals to create IM products which are transmitted back from the amplifier 40*a* through the filter and isolator 25*a* to the antenna element 10*a*, where they are transmitted to the air interface.

In a normal situation the IM products created by a given interfering signal would be reflected back along a plane parallel to the antenna column. This is due to the fact that the interfering signals we are primarily concerned with here are those from adjacent antenna columns. They will arrive to adjacent columns on the tower in phase and then be transmitted back in phase.

In the embodiment of the present invention shown in FIG. 4, however, the interfering signal, and therefore the corresponding IM products, will be forced to travel a longer distance for each subsequent antenna element. For example, the distance the IM products must travel is L for the first antenna element 10*a*, while it is L+7dL for the eighth antenna element 10*h*. It can be seen that the distance travelled for the IM products increases as we proceed from the first antenna element 10*a* to the eighth 10*h*. This produces a greater delay as we move from the first element 10*a* to the eighth 10*h*.

This delay causes a tilt in the wavefront of the IM products wave produced from a given interfering signal. However, as we saw above, the desired signal arrives at each antenna element 10*a*–10*h* simultaneously, so there is no tilt in the wavefront for the desired signal. This shift in the relation of the phase of the desired signal in relation to the IM products results in redirected interference from the IM products.

Figure 5:
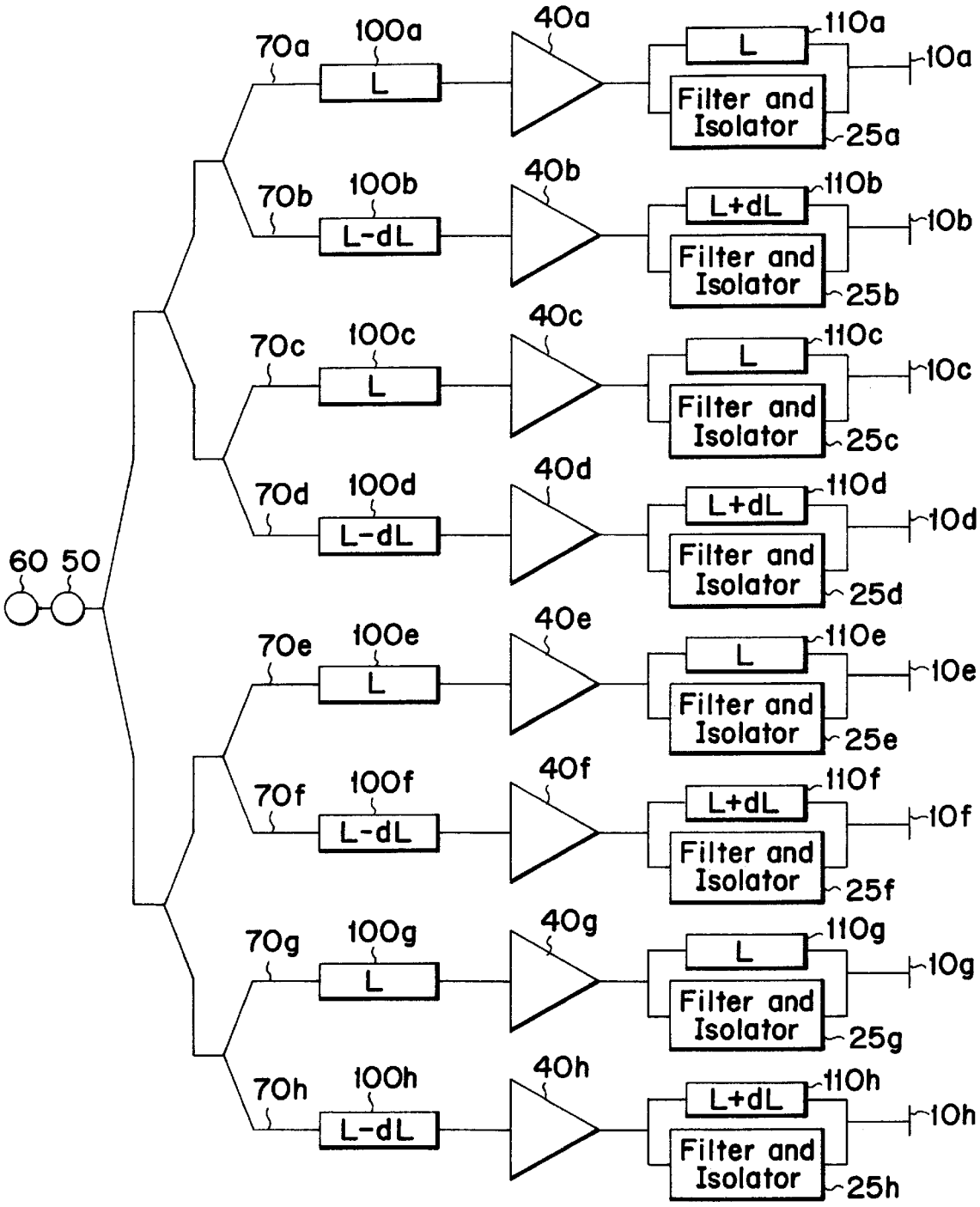
FIG. 5 illustrates a cutaway view of an alternative embodiment of the present invention wherein the transmission lengths are varied to provide opposite phase generation for the IM products.

Another embodiment of the present invention is shown in FIG. 5. Similar to FIG. 4, an opposite phase intermodulation ("IM") product generation for the case of an 8 dipole antenna column is shown. Here again an 8 dipole column is chosen here for ease of explanation, and the present invention will work for any number of antenna elements in a column. The radio signal begins at a source 60 located in a base station, not shown here. The signal is split in a splitter, 50 FIGS. 1, 2, and then sent to the various antenna elements 10*a*–10*h* along a variety of paths 70*a*–70*h*. Each antenna element 10*a*–10*h* has its own amplifier 40*a*–40*h*, respectively, and filter-isolator 25*a*–25*h*, respectively, (shown located together for illustration purposes).

The distance L is here again the electrical wavelength. A distance dL is then calculated from dL=(L/2)/N, where N is the number of antenna elements in the column. In FIG. 5 N=8, so dL=(L/2)/8. The distance of the first part of the signal path, symbolised by block 100*a*, the signal travels to the first amplifier 40*a* is equal to L, which is also equal to the distance of the second part of the signal path, symbolised by block 110*a*, the signal must subsequently travel to the first antenna element 10*a*. It is seen that the total distance travelled for the signal from the splitter 50 to the first antenna element 10*a* is 2L.

This contrasts with the distances for antenna element number two 10*b*. Here the signal first travels a first part of the signal path corresponding to a distance 100*b* equal to L−dL to the second amplifier 40*b* before travelling a second part of the signal path corresponding to a distance 110*b* equal to L+dL between the second amplifier 40*b* and the second antenna element 10*b*. Here the signal travels again a total distance of 2L between the splitter 50 and the second antenna element 10*b*.

For each subsequent antenna element 10*a*–10*h* the first part of the signal paths corresponding to the distances 100*a*–100*h* between the splitter 50 and amplifiers 40*a*–40*h* are alternated between L and L−dL, while the corresponding second parts of the signal paths corresponding to the distances 110*a*–110*h* between the amplifiers 40*a*–40*h* and antenna elements 10*a*–10*h* are alternated between L and L+dL. For any given amplifier 40*a*–40*h* numbered N, N an odd number, the distance travelled by the signal from the splitter 50 to amplifier 40*a*–40*h* is L. For any given amplifier 40*a*–40*h* numbered N, N an even number, the distance travelled by the signal from the splitter 50 to amplifier 40*a*–40*h* is equal to L−dL.

For any given amplifier 40*a*–40*h* numbered N, N an odd number, the distance then travelled by the signal from the amplifier 40*a*–40*h* to its corresponding antenna element 10*a*–10*h* is equal to L. For any given amplifier 40*a*–40*h* numbered N, N an even number, the distance then travelled by the signal from the amplifier 40*a*–40*h* to its corresponding antenna element 10*a*–10*h* is equal to L+dL. So, for example, the distance travelled by the signal from the eighth amplifier (N=8) to the eighth antenna element is L+dL. However, it will quickly be seen that the total distance travelled by the signal in every case from the splitter 50 to antenna element 10*a*–10*h* is equal to 2L. Therefore the distance travelled by the signal remains in phase in every case.

It can be appreciated by the symmetry of the situation shown in FIG. 5 that the situation can be easily reversed between the odd-numbered paths and the even-numbered paths. It is also possible to design the system so that the first four lengths from the splitter 50 to the first four amplifiers 40*a*–40*d* will all be equal to L. The lengths between the first four amplifiers 40*a*–40*d* and their respective antenna elements 10*a*–10*d* will also be equal to L.

In turn, the lengths of the second four lengths from the splitter 50 to the second four amplifiers 40*e*–40*h* will all be L−dL. The lengths between the second four amplifiers 40*e*–40*h* and their respective antenna elements 10*e*–10*h* will all be L+dL. As above, the symmetry here means that the lengths from the splitter 50 to the first four amplifiers 40*a*–40*d* can all be L−dL while they would then be equal to L from the splitter 50 to the second four amplifiers 40*e*–40*h*. The lengths from the first four amplifiers 40*a*–40*d* to their respective antenna elements 10*a*–10*d* will also be equal to L+dL while from the second four amplifiers 40*e*–40*h* to their respective antenna elements 10*e*–10*h* will be equal to L.

The situation is again far different in this embodiment, however, when we consider the IM products. Interfering signals are received from nearby antenna columns at the various antenna elements. These interfering signals then are forced backwards from the antenna element, e.g. 10*a*, through the filter and isolator, 25*a* respectively, to the amplifier, 40*a* respectively. They then combine with the desired signals to create IM products which are transmitted back from the amplifier 40*a* through the filter and isolator 25*a* to the antenna element 10*a*, where they are transmitted to the air interface.

In a normal situation the IM products created by a given interfering signal would be reflected back along a plane parallel to the antenna column. This is due to the fact that the interfering signals we are primarily concerned with here are those from adjacent antenna columns which reach an adjacent column in phase. In the embodiment of the present invention shown in FIG. 5, however, the interfering signal, and therefore the corresponding IM products, will be forced to travel a different distance for each pair of antenna elements 10*a*–10*h*. For example, the distance the IM products must travel is L for the first antenna element 10*a*, while it is L+dL for the second antenna element 10*b*. It is then L again for the third antenna element 10*c* and again L+dL for the fourth antenna element 10*d*.

It can be seen that the distance travelled for the IM products alternates between L and L+dL as we proceed from the first antenna element 10*a* to the eighth antenna element 10*d*. The wavefront for the IM products from the even numbered antenna elements, here 10*b*, 10*d*, 10*f*, and 10*h*, will be shifted in relation to the wavefront for the IM products from the odd numbered antenna elements, here 10*a*, 10*c*, 10*e*, and 10*g*. This will result in less coherence among the IM products.

However, as we saw above, the desired signal arrives at each antenna element 10*a*–10*h* simultaneously, so there is no tilt in the wavefront for the desired signal. This shift in the relation of the phase of the desired signal in relation to the IM products results in decreased interference from the IM products.

Figure 6:
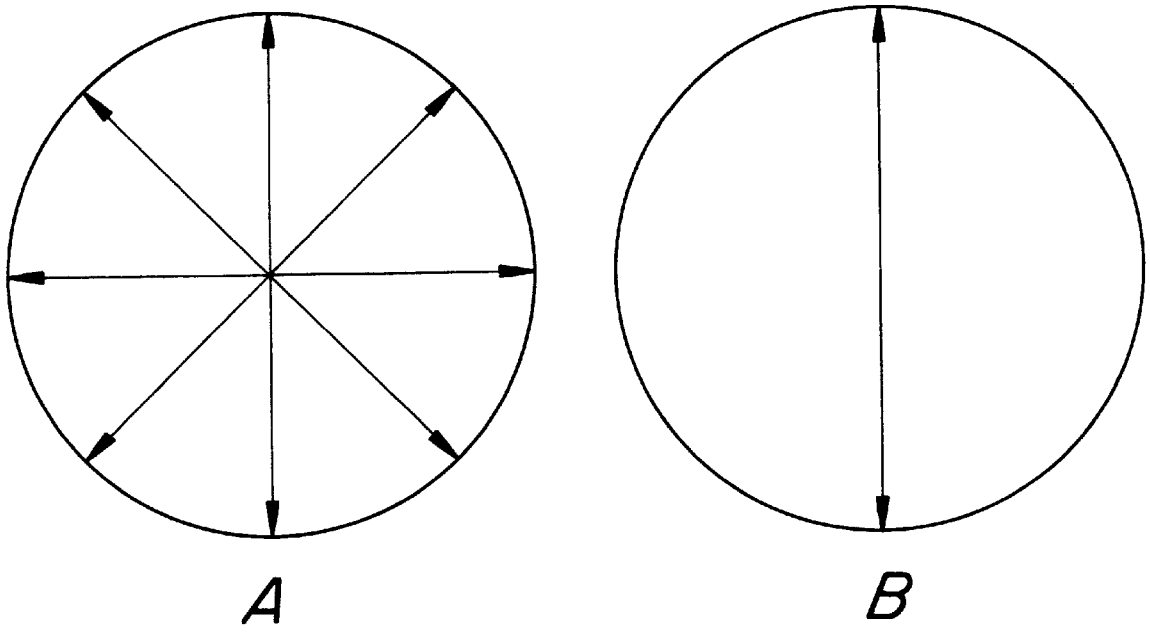
FIG. 6 shows the phase vector diagrams for both the preferred embodiment and the alternative embodiment.

In FIG. 6 is shown two phase vector diagrams for the embodiments shown in FIGS. 4 and 5. In the first diagram A it can be seen that the phase is divided into eight, corresponding to the eight different antenna elements of FIG. 4. This illustrates that the phase of the IM products from each subsequent antenna element will be shifted further by one-eighth in relation to the carrier signal. It can be appreciated that a system with N antenna elements will divide the first diagram A into N. Compared with this is the second diagram B which corresponds to the embodiment shown in FIG. 5. Here the IM products alternate between being in phase with the carrier to being 180 degrees out of phase.

The result of the present invention is a reduction in the IM products generated by the power amplifiers in antenna columns. Typical levels of IM products are about 80 dBm. This can be calculated as:

IM30=P0-ITxTx-II-IM3-IL-IF

IM30=IM3 output level

ITxRx=Isolation between Rx and Tx antennas

ITxTx=Isolation between Tx antennas

IL=Insertion loss Tx path

IM3=IM generated by Power amplifier

P0=Transmitter power output

IF=Isolation filter

IL=Isolation isolator.

Typical values might be: IM30=+33 dBm−30 dB−45 dB−15 dB−3 dB−20 dB=−80 dBm. As the present invention lowers the IM products generated by the power amplifier the result is a lower output level of IM products. Expected improvements might be in the range of 10–20 dB, depending on the particular system implementations. The resulting improvements in IM output products can also allow lower standards required for the amplifiers, filters and isolators which can greatly save in costs.

The embodiments described above serve merely as illustration and not as limitation. It will be apparent to one of ordinary skill in the art that departures may be made from the embodiments described above without departing form the spirit and scope of the invention. Therefore, the invention should not be regarded as being limited to the examples described, but should be regarded instead as being equal in scope to the following claims.

What is claimed is:

1. An antenna column comprising: N antenna elements, N an integer greater than 1, each of said antenna elements having its own corresponding amplifier, filter-isolator, and a common radio source for transmitting radio signals of wavelength L to each of said N antenna elements by N fixed and different paths, wherein:

each of said N fixed and different paths has a first part defining a length and a second part defining a length, said first part being the part of said path between a splitter shared by all N fixed and different paths and each said amplifier, and said second part being the part of said path between each said amplifier and its said corresponding antenna element, wherein a sum of the lengths of said first part and said second part of each path is equal to 2L, and where the lengths of the different parts of the paths are chosen in a way so that a sum of phase vectors of intermodulation products is substantially zero.

2. The antenna column of claim 1, wherein the length of said first part of each of said N paths is equal to $$L-(n-1)\left(\frac{L}{2N}\right)$$

and the length of said second part of said paths is equal to $$L+(n-1)\left(\frac{L}{2N}\right),$$

n an integer varying between 1 and N.

3. The antenna column of claim 1, wherein the length of said first part of the odd numbered paths of said N paths is equal to L and the length of said second part of the odd numbered paths of said N paths is equal to L, and the length of said first part of the even numbered paths of said N paths $$L-\left(\frac{L}{2N}\right)$$

while the length of said second part of the even numbered paths of said N paths is $$L+\left(\frac{L}{2N}\right).$$

4. The antenna column of claim 1, wherein the length of said first part of the even numbered paths of said N paths is equal to L and the length of said second part of the even numbered paths of said N paths is equal to L, and the length of said first part of the odd numbered paths of said N paths $$L-\left(\frac{L}{2N}\right)$$

while the length of said second part of the odd numbered paths of said N paths is $$L+\left(\frac{L}{2N}\right).$$

5. The antenna column of claim 1, wherein the length of said first part of the first N=1 to N=N/2 paths of said N paths is equal to L and the length of said second part of the first N=1 to N=N/2 paths of said N paths is equal to L, and the length of said first part of the N=N/2 to N=N paths of said N paths equals $$L-\left(\frac{L}{2N}\right)$$

while the length of said second part of the N=N/2 to N=N paths of said N paths $$L+\left(\frac{L}{2N}\right).$$

6. The antenna column of claim 1, wherein the length of said first part of the N=N/2 to N=N paths of said N paths is equal to L and the length of said second part of the N=N/2 to N=N paths of said N paths is equal to L, and the length of said first part of the first N=1 to N=N/2 paths of said N paths equals $$L-\left(\frac{L}{2N}\right)$$

while the length of said second part of the first N=1 to N=N/2 paths of said N paths is $$L+\left(\frac{L}{2N}\right).$$

* * * * *